United States Patent [19]

Proud et al.

[11] 4,427,920

[45] Jan. 24, 1984

[54] ELECTROMAGNETIC DISCHARGE APPARATUS

[75] Inventors: Joseph M. Proud, Wellesley Hills; Robert K. Smith, Wilmington; Charles N. Fallier, Jr., Westford, all of Mass.

[73] Assignee: GTE Laboratories Incorporated, Waltham, Mass.

[21] Appl. No.: 307,418

[22] Filed: Oct. 1, 1981

[51] Int. Cl.[3] ..... H05B 41/16; H05B 41/24

[52] U.S. Cl. ..... 315/248; 315/39; 313/638

[58] Field of Search ..... 315/248, 39; 313/227, 313/228, 229, 637, 638, 639, 640, 641

[56] References Cited

U.S. PATENT DOCUMENTS 4,001,632 1/1977 Haugsjaa et al. ..... 315/39

4,266,162 5/1981 McNeill et al. ..... 315/248

4,266,167 5/1981 Proud et al. ..... 315/248

FOREIGN PATENT DOCUMENTS 457797 12/1936 United Kingdom ..... 315/248

*Primary Examiner*—Saxfield Chatmon

*Attorney, Agent, or Firm*—David M. Keay

[57] ABSTRACT

An electromagnetic discharge apparatus including an electrodeless lamp containing a fill material which emit light when subjected to a high frequency electric field. Power is coupled to the contents of the lamp by a coupling fixture having an outer conductor of conductive mesh and an inner conductor. The electrodeless lamp is mounted between two electrodes, one from the inner conductor and one from the outer conductor which terminate closely adjacent to opposite outer surfaces of the electrodeless lamp.

11 Claims, 5 Drawing Figures

ELECTROMAGNETIC DISCHARGE APPARATUS

BACKGROUND OF THE INVENTION

This invention relates to electromagnetic discharge apparatus. More particularly, it is concerned with electrodeless light sources.

Electrodeless light sources which operate by coupling high frequency power to an arc discharge in an electrodeless lamp have been developed. These light sources typically include a high frequency power source connected to a coupling fixture with an inner conductor and an outer conductor disposed around the inner conductor. The electrodeless lamp is positioned adjacent to the end of the nner conductor. High frequency power is coupled to a light emitting electromagnetic discharge within the electrodeless lamp. A portion of the coupling fixture passes radiation at the wavelengths of the light produced, this permitting the use of the apparatus as a light source.

SUMMARY OF THE INVENTION

It is an object of the present invention to provide an improved electromagnetic discharge apparatus.

It is another object of the invention to provide an improved electromagnetic discharge apparatus which employs an electrodeless lamp as a source of light.

An improved source of light is provided by electromagnetic discharge apparatus in accordance with the present invention. The apparatus comprises an electrodeless lamp having an envelope of a light transmitting substance. The envelope has opposite first and second outer surfaces. The fill material within the envelope is capable of emitting light upon breakdown and excitation when subjected to a high frequency electric field. The apparatus also includes an inner conductor and an outer conductor dispensed around the outer conductor. The conductors have means at one end which are adapted for coupling to a high frequency power source. A first electrode is connected to the other end of the inner conductor and has a surface adjacent to the first outer surface of the envelope of the electrodeless lamp. A second electrode is connected to the other end of the outer conductor and has a surface adjacent to the second outer surface of the envelope of the electrodeless lamp. When high frequency power is applied to the inner and outer conductors, a high frequency electric field is produced between the first and second electrodes causing breakdown and excitation of the fill material within the envelope.

For a better understanding of the present invention, together with other and further objects, advantages, and capabilities thereof, reference is made to the following discussion and appended claims in connection with the above-described drawings.

DETAILED DESCRIPTION OF THE INVENTION

Figure 1:
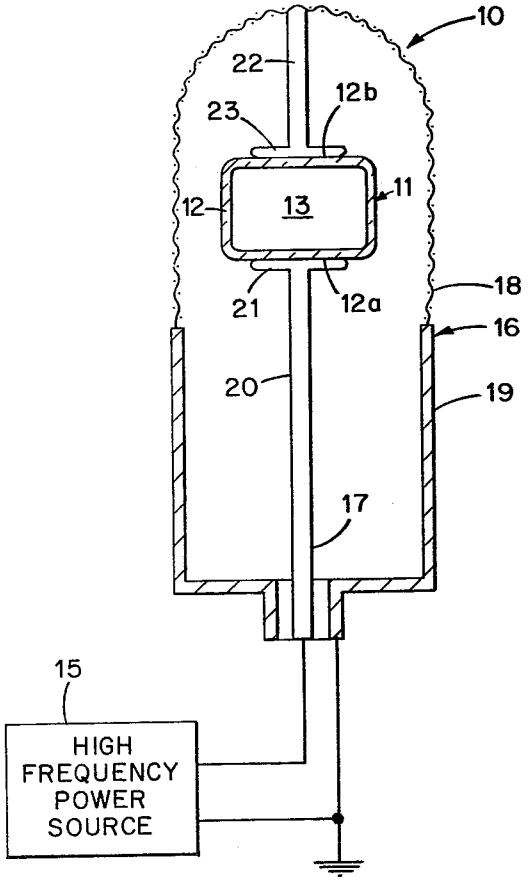
FIG. 1 is a schematic representation of an electromagnetic discharge apparatus in accordance with the present invention.

FIG. 1 is a schematic representation of an electromagnetic discharge apparatus 10 in accordance with the present invention. The apparatus 10 includes an electrodeless lamp 11 having a sealed envelope 12 made of a suitable material which is transparent to light. The fill material 13 within the lamp envelope may be any of various materials which break down and are excited by the application of high frequency power to produce light. For example, the fill material may include a mercury halide as described in application Ser. No. 307,420 filed concurrently herewith by Stephen G. Johnson and Joseph M. Proud entitled "Electrodeless Light Source." The envelope 12 of the electrodeless lamp 11 is of circular configuration. The envelope 12 has a lower surface 12*a* and an upper surface 12*b* which are generally parallel.

High frequency power is applied to the fill material 13 in the envelope 12 as from a high frequency power source 15 through a coupling fixture 16. The coupling fixture 16 includes an inner conductor 17 encircled by an outer conductor 18. The outer conductor 18 may be of any suitable material to provide a conductive mesh which permits light radiating from the electrodeless lamp to pass through the fixture while containing radio frequency fields within the fixture. The conductive mesh 18 is electrically connected to a conductive base member 19 which together with the inner conductor 17 provides a coaxial connection for permitting appropriate connection to the high frequency power source 15.

Connected to the inner conductor 17 (shown as an extension thereof in FIG. 1) is a lower electrode 20 which terminates in an electrode member 21 having a large surface area. The electrode member 21 is of a size to be in contact with a major portion of the lower surface 12*a* of the electrodeless lamp envelope 12. An upper electrode 22 is electrically connected to the wire mesh outer conductor 18. The upper electrode 22 terminates in an electrode member 23 also having a large surface area. The electrode member 23 extends over and is adjacent to a major portion of the outer surface 12*b* of the envelope 12 of the electrodeless lamp.

As illustrated in FIG. 1 the electrodeless lamp 11 is located along the central axis of the apparatus. The inner conductor 17 and lower electrode 21 extend along the central axis. The upper electrode 22 extends along the central axis from the central point of the dome-shaped outer conductor 18. The electrodes 20 and 22 terminate in large area members 21 and 23 which are in contact with major portions of the opposite surfaces 12*a* and 12*b*, respectively, of the electrodeless lamp envelope 12. The close spacing of the electrode members 21 and 23 provides a high value of electric field to pressure ratio within the fill material thus leading to better breakdown characteristics. A high field to pressure ratio is desirable when it is necessary to provide high electron temperature in a plasma discharge. The preferred frequencies for exciting the fill material are those radio frequencies allocated for industrial, scientific, or medical usages located at 13.56, 27.13, 40.68, 915, or 2450 MHz. However, useful frequencies lie within the range of from 1 MHz to 10 GHz.

Figure 2:
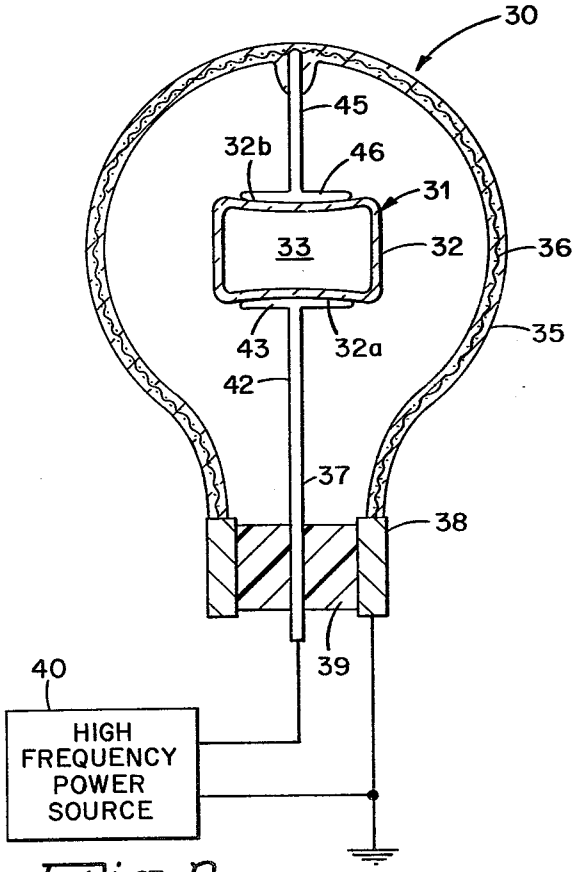
FIG. 2 is an elevational view in cross-section of one embodiment of electromagnetic discharge apparatus in accordance with the present invention.

FIG. 2 illustrates one embodiment of an electromagnetic discharge apparatus in accordance with the invention. The apparatus 30 includes an electrodeless lamp 31 having a sealed envelope 32 of a material which is transparent to the light emitted by the fill material 33 within the envelope. The opposite lower and upper surfaces 32*a* and 32*b* of the lamp envelope 32 are concave.

The electrodeless lamp 31 is positioned along the central axis of the apparatus within an outer envelope 35 which as shown in FIG. 2 may be of typical pear-shaped lamp configuration. The outer envelope 35 is also of a light transmitting substance. An outer conductor 36 is a conductive mesh of the same configuration as the outer envelope 35. The conductive mesh 36 may be laminated within the material of the outer envelope 35 as illustrated in FIG. 2. Alternatively, the mesh may be closely adjacent to either the outer surface or the inner surface of the outer envelope 35. The mesh may be formed as a conductive pattern metallized on the surface of the outer envelope. The lower edge of the outer envelope 35 is fixed to a conductive base member 38 which is electrically connected to the conductive mesh 36.

An inner conductor 37 extends along the central axis and is encircled by the outer conductor 36. The inner conductor 37 is supported in the base member 38 by an insulating member 39. The base member 38 and the outer end of the inner conductor 37 form a coaxial arrangement adapted for making connection to a high frequency power source 40.

A lower electrode 42 extends from the inner conductor 37 along the central axis and terminates in a electrode member 43. The electrode member 43 has a convex upper surface which mates closely with the indentation in the concave lower surface 32*a* of the electrodeless lamp envelope 32. An upper electrode 45 which is supported by the outer envelope 35 extends from the upper central point of the conductive mesh 36. The upper electrode 45 terminates at its lower end in a member 46 which bulges to conform with the indentation in the upper surface 32*b* of the electrodeless lamp 31.

The mating concave-convex configurations of the surfaces 32*a* and 32*b* of the electrodeless lamp 31 and the electrode members 43 and 46 intensify the electric field to pressure ratio within the discharge volume and localize it along the central axis. In addition the electrodeless lamp 31 is readily positioned and supported in its proper position. The angle through which the excited discharge radiates light is opened more widely by virtue of the configuration of the lamp envelope and matching electrode members.

Figure 3:
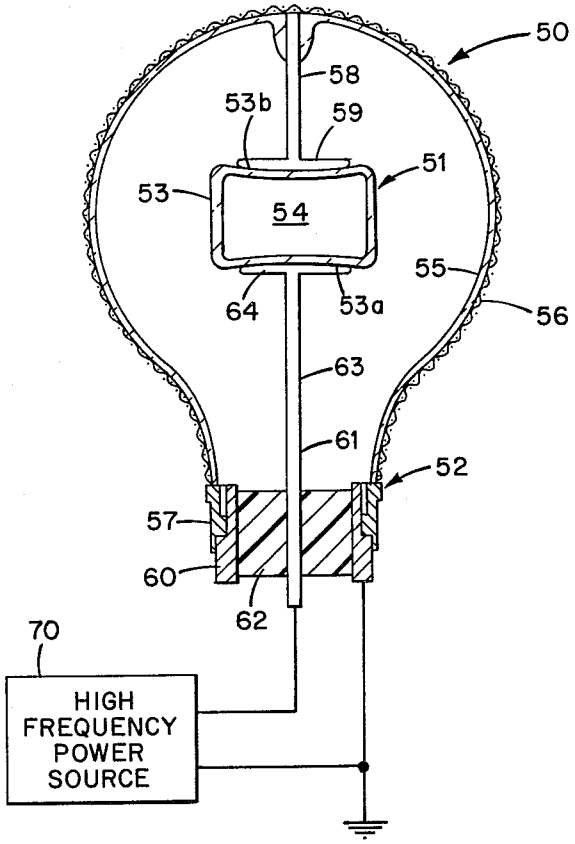
FIG. 3 is an elevational view in cross-section of another embodiment of electromagnetic discharge apparatus in accordance with the present invention.

FIG. 3 illustrates an electrical discharge apparatus 50 including an electrodeless lamp 51 and a demountable coupling fixture 52. The electrodeless lamp 51 includes a sealed envelope 53 containing a fill material 54 which emits suitable radiation upon excitation by an electric field. The lamp envelope 53 has concave lower and upper surfaces 53*a* and 53*b* similar to the embodiment of FIG. 2.

One unit of the coupling fixture 52 includes an outer envelope 55 of a material which is transparent to the light emitted by the fill material 54 of the electrodeless lamp 51. The outer envelope 55 is shown in FIG. 3 as being pear-shaped. An outer conductor 56 of some form of conductive mesh is mounted close to the outer surface of the envelope 55. The lower end of the outer envelope 56 is fixed to a conductive outer base member 57 to which the conductive mesh 56 is connected. An electrode 58 which is supported in the outer envelope 55 is electrically connected to the outer conductive mesh 56. The electrode 58 extends along the central axis of the apparatus and terminates in an electrode member 59 having a similar configuration to that shown in FIG. 2 in order to mate with the indentation in the surface 53*b* of the envelope 53.

The other unit of the coupling fixture 52 includes a conductive inner base member 60 which encircles an inner conductor 61 and is spaced therefrom by insulating material 62. The lower end of the inner conductor 61 and the inner base member 60 provide a coaxial arrangement which is adapted for connection to a high frequency power source 70. A lower electrode 63 extends along the central axis of the apparatus from the inner conductor 61 and terminates in an electrode member 64 having a surface area which bulges to fit with the surface area 53*a* of electrodeless lamp 51.

The outer base member 57 of the first unit of the coupling fixture is removably engageable with the inner base member 60 of the other unit. A conventional bayonnet-type mounting may be employed. When assembled the apparatus appears as in FIG. 3 with the electrode members 64 and 59 contiguous with the surfaces 53*a* and 53*b*, respectively, of the electrodeless lamp 51. When the outer base member 57 is disengaged from the inner base member 60, the apparatus is separated into the two units of the coupling fixture 52 and the electrodeless lamp 51.

Figure 4:
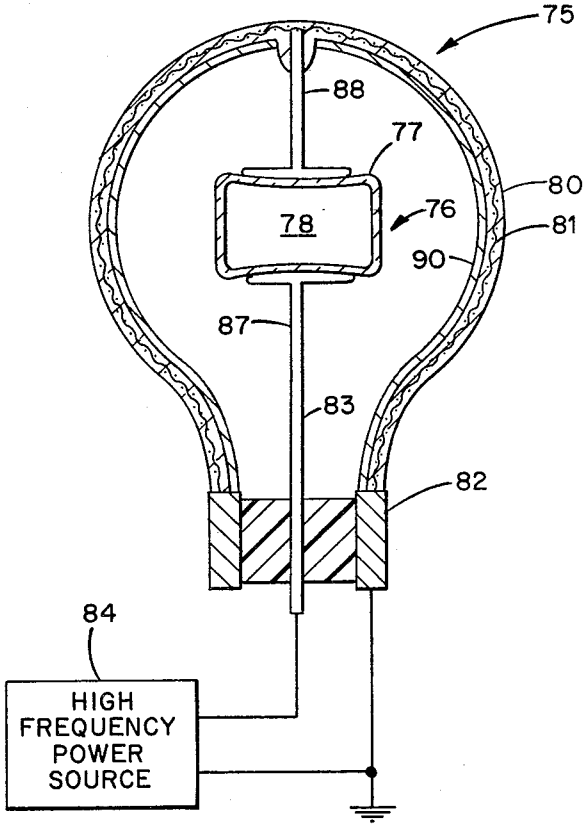
FIGS. 4 and 5 illustrate modifications of the apparatus of FIG. 2.

FIG. 4 illustrates a modification of the apparatus of FIG. 2. The apparatus 75 is similar to that of FIG. 2 in that it includes an electrodeless lamp 76 having a sealed inner envelope 77 containing a fill material 78. The apparatus also includes an outer envelope 80 and an outer conductor 81 of conductive mesh. The lower edge of the outer envelope is fixed to a base member 82. An inner conductor 83 is supported in the base member. The base member 82 and inner conductor form a coaxial arrangement for making connection to a high frequency power source 84. The electrodeless lamp 76 is positioned between a lower electrode 87 from the inner conductor 83 and an upper electrode 88 connected to the conductive mesh 81.

The apparatus 75 of FIG. 4 also includes a layer of phosphor material 90 which is adherent to the inner surface of the outer envelope 80. The apparatus thus may be employed as a fluorescent light source as described in application Ser. No. 307,556 filed concurrently herewith by Joseph M. Proud and Stephen G. Johnson entitled "Electrodeless Fluorescent Light Source."

Figure 5:
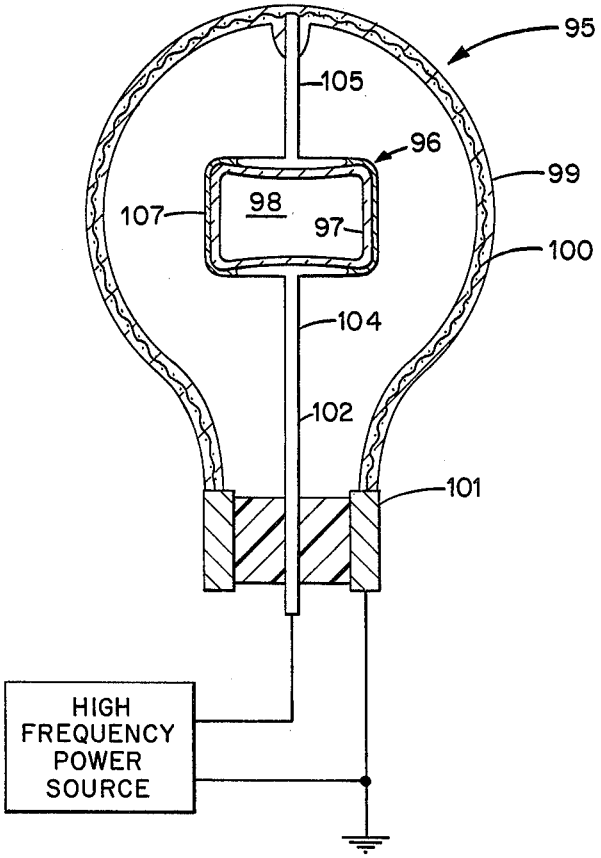

FIG. 5 illustrates another modification of the apparatus of FIG. 2. The apparatus 95 includes an electrodeless lamp 96 having a sealed inner envelope 97 containing a fill material 98. The apparatus also includes an outer envelope 99, an outer conductor 100 of conductive mesh, a base member 101, an inner conductor 102, a high frequency power source 103, and lower and upper electrodes 104 and 105. A layer of phosphor material 107 is adherent to the outer surface of the inner envelope 97. Thus, this apparatus may also be employed as a fluorescent light source as described in the abovementioned application Ser. No. 307,556 of Proud and Johnson.

While there has been shown and described what are considered preferred embodiments of the present invention, it will be obvious to those skilled in the art that various changes and modifications may be made therein without departing from the invention as defined by the appended claims.

What is claimed is:

1. Electromagnetic discharge apparatus comprising
an electrodeless lamp having an envelope of a light transmitting substance, the envelope having opposite first and second outer surfaces;
a fill material within the envelope capable of emitting light upon breakdown and excitation when subjected to a high frequency electric field;
an inner conductor;
an outer conductor disposed around the inner conductor;
the conductors having means at one end adapted for coupling to a high frequency power source;
a first electrode connected to the other end of said inner conductor and having a surface adjacent to said first outer surface of the envelope of the electrodeless lamp; and
a second electrode connected to the other end of said outer conductor and having a surface adjacent to said second outer surface of the envelope of the electrodeless lamp;
wherein
the electrodeless lamp is centered on the central axis of the apparatus;
said outer conductor includes conductive mesh encircling said electrodeless lamp and spaced therefrom;
said inner conductor extends along said central axis;
said first electrode extends along said central axis from said inner conductor and terminates in a first electrode member generally transverse to said central axis and having a surface area contiguous with a major portion of said first outer surface of the envelope of the electrodeless lamp;
said second electrode extends along said central axis from said conductive mesh and terminates in a second electrode member generally transverse to said central axis and having a surface area contiguous with a major portion of said second outer surface of the envelope of the electrodeless lamp; and
said first and second electrode members are disposed generally parallel to each other and are closely spaced to provide a high value of electric field to pressure ratio within the fill material
whereby when high frequency power is applied to said inner and outer conductors, a high frequency electric field is produced between the first and second electrodes causing breakdown and excitation of the fill material within the envelope.

2. Electromagnetic discharge apparatus in accordance with claim 1 wherein
the envelope of the electrodeless lamp has an indentation in said first outer surface extending inwardly toward said opposite second outer surface and has an indentation in said second outer surface extending inwardly toward said opposite first outer surface;
said surface area of said first electrode member bulges outwardly into the indentation in said first outer surface of the envelope into mating contact therewith; and
said surface area of said second electrode member bulges outwardly into the indentation in said second outer surface of the envelope into mating contact therewith.

3. Electromagnetic discharge apparatus in accordance with claim 1 wherein
said first outer surface of the envelope of the electrodeless lamp is concave inwardly;
said second surface of the envelope of the electrodeless lamp is concave inwardly;
said surface area of said first electrode member is convex outwardly closely mating with the concave first outer surface of the envelope of the electrodeless lamp; and
said surface area of said second electrode member is convex outwardly closely mating with the concave second outer surface of the envelope of the electrodeless lamp.

4. Electromagnetic discharge apparatus comprising
an electrodeless lamp having an inner envelope of a light transmitting substance, the inner envelope having opposite first and second outer surfaces;
a fill material within the inner envelope capable of emitting light upon breakdown and excitation when subjected to a high frequency electric field;
an outer envelope of a light transmitting substance surrounding said inner envelope and spaced therefrom;
an outer conductor including conductive mesh adjacent to said outer envelope;
an inner conductor encircled by the outer conductor;
the conductors having means at one end adapted for coupling to a high frequency power source;
a first electrode connected to the other end of said inner conductor and having a surface adjacent to said first outer surface of the inner envelope of the electrodeless lamp; and
a second electrode connected to the conductive mesh and having a surface adjacent to said second outer surface of the inner envelope of the electrodeless lamp;
wherein
said inner envelope is centered on the central axis of the apparatus with said first and second outer surfaces generally transverse thereto;
said inner conductor extends along said central axis;
said first electrode extends along said central axis from said inner conductor and terminates in a first electrode member generally transverse to said central axis and having a surface area contiguous with a major portion of said first outer surface of the inner envelope;
said second electrode extends along said central axis from said conductive mesh and terminates in a second electrode member generally transverse to said central axis and having a surface area contiguous with a major portion of said second outer surface of the inner envelope; and
said first and second electrode members are disposed generally parallel to each other and are closely spaced to provide a high value of electric field to pressure ratio within the fill material
whereby when high frequency power is applied to said inner and outer conductors, a high frequency electric field is produced between the first and second electrodes causing breakdown and excitation of the fill material within the envelope.

5. Electromagnetic discharge apparatus in accordance with claim 4 including
a layer of phosphor material adherent to the outer surface of said inner envelope.

6. Electromagnetic discharge apparatus in accordance with claim 4 including
a layer of phosphor material adherent to the inner surface of said outer envelope.

7. Electromagnetic discharge apparatus in accordance with claim 4 wherein the inner envelope of the electrodeless lamp has an indentation in said first outer surface extending inwardly toward said opposite second outer surface and has an indentation in said second outer surface extending inwardly toward said opposite first outer surface;

said surface area of said first electrode member bulges outwardly into the indentation in said first outer surface of the envelope into mating contact therewith; and said surface area of said second electrode member bulges outwardly into the indentation in said second outer surface of the envelope into mating contact therewith.

8. Electromagnetic discharge apparatus in accordance with claim 4 wherein said first outer surface of the inner envelope of the electrodeless lamp is concave inwardly;

said second surface of the inner envelope of the electrodeless lamp is concave inwardly;

said surface area of said first electrode member is convex outwardly closely mating with the concave first outer surface of the envelope of the electrodeless lamp; and said surface area of said second electrode member is convex outwardly closely mating with the concave second outer surface of the envelope of the electrodeless lamp.

9. Electromagnetic discharge apparatus comprising an electrodeless lamp centered on the central axis of the apparatus and having an inner envelope of a light transmitting substance, the inner envelope having opposite first and second outer surfaces;

a fill material within the envelope capable of emitting light upon breakdown and excitation when subjected to a high frequency electric field;

a coupling fixture for coupling high frequency electric power to said electrodeless lamp comprising a first unit and a second unit;

said first unit of the coupling fixture including an inner conductor extending along said central axis, a first electrode fixed to said inner conductor and terminating in a first electrode member generally transverse to said central axis and having a surface area contiguous with a major portion of said first outer surface of the inner envelope, and a conductive inner base member affixed to the inner conductor adjacent to the end thereof spaced from said first electrode member and electrically insulated therefrom;

said second unit of the coupling fixture including an outer envelope of a light transmitting substance surrounding said inner envelope and spaced therefrom, conductive mesh surrounding said inner envelope and fixed to said outer envelope, a second electrode supported by said outer envelope and electrically connected to said conductive mesh, said second electrode extending along said central axis from said conductive mesh and said outer envelope and terminating in a second electrode member generally transverse to said central axis and having a surface area contiguous with a major portion of said second outer surface of the inner envelope, and a conductive outer base member affixed to said outer envelope and electrically connected to said conductive mesh, said conductive outer base member encircling said conductive inner base member of the first unit and being removably engagable therewith;

said first and second units of the coupling fixture and the electrodeless lamp being assembled with the conductive outer base member of the second unit engaging the conductive inner base member of the first unit, the first electrode member being contiguous the major portion of said first outer surface of the inner envelope, the second electrode member being contiguous the major portion of the second outer surface of the inner envelope, and the first and second electrode members being closely spaced to provide a high value of electric field to pressure ratio within the fill material whereby when said first unit and said second unit of said coupling fixture are assembled with said conductive inner base member of the first unit in engagement with the conductive outer base member of the second unit and the electrodeless lamp between the first and second electrode members and when high frequency power is applied to said inner conductor and said conductive base member, a high frequency electric field is produced between the first and second electrodes causing breakdown and excitation of the fill material within the inner envelope; and whereby said apparatus may be separated into said electrodeless lamp, said first unit, and said second unit by disengaging the conductive outer base member of the second unit from the conductive inner base member of the first unit.

10. Electromagnetic discharge apparatus in accordance with claim 9 wherein the inner envelope of the electrodeless lamp has an indentation in said first outer surface extending inwardly toward said opposite second outer surface and has an indentation in said second outer surface extending inwardly toward said opposite first outer surface;

said surface area of said first electrode member bulges outwardly into the indentation in said first outer surface of the envelope into mating contact therewith; and said surface area of said second electrode member bulges outwardly into the indentation in said second outer surface of the envelope into mating contact therewith.

11. Electromagnetic discharge apparatus in accordance with claim 9 wherein said first outer surface of the inner envelope of the electrodeless lamp is concave inwardly;

said second surface of the inner envelope of the electrodeless lamp is concave inwardly;

said surface area of said first electrode member is convex outwardly closely mating with the concave first outer surface of the envelope of the electrodeless lamp; and said surface area of said second electrode member is convex outwardly closely mating with the concave second outer surface of the envelope of the electrodeless lamp.

* * * * *